US012145043B2

(12) United States Patent
O'Connor

(10) Patent No.: US 12,145,043 B2
(45) Date of Patent: Nov. 19, 2024

(54) PUNCH BAG SUPPORT ASSEMBLY

(71) Applicant: Noel O'Connor, Manchester (GB)

(72) Inventor: Noel O'Connor, Manchester (GB)

( * ) Notice: Subject to any disclaimer, the term of this patent is extended or adjusted under 35 U.S.C. 154(b) by 114 days.

(21) Appl. No.: 17/789,840

(22) PCT Filed: Dec. 31, 2020

(86) PCT No.: PCT/IB2020/062599

§ 371 (c)(1),
(2) Date: Jun. 29, 2022

(87) PCT Pub. No.: WO2021/137195

PCT Pub. Date: Jul. 8, 2021

(65) Prior Publication Data

US 2023/0034376 A1 Feb. 2, 2023

(30) Foreign Application Priority Data

Dec. 31, 2019 (GB) ..... 1919459

(51) Int. Cl.
*A63B 69/24* (2006.01)
*A63B 69/20* (2006.01)

(52) U.S. Cl.
CPC ..... *A63B 69/244* (2022.08); *A63B 69/305* (2022.08); *A63B 2244/10* (2013.01)

(58) Field of Classification Search
CPC ..... A63B 69/22–305
See application file for complete search history.

(56) References Cited

U.S. PATENT DOCUMENTS 2,156,831 A * 5/1939 Andre ..... A63B 69/305 383/22
5,048,822 A * 9/1991 Murphy ..... A63B 69/305 482/7
5,352,170 A 10/1994 Condo et al.
5,725,458 A * 3/1998 Newman ..... A63B 69/30 482/90
6,063,011 A 5/2000 Pelchat
6,758,794 B2 * 7/2004 Lee ..... A63B 69/244 482/90
7,862,485 B2 1/2011 Luigi
7,993,249 B1 * 8/2011 Fassl ..... A63B 69/3623 482/90
2003/0158017 A1 8/2003 Lee (Continued)

FOREIGN PATENT DOCUMENTS

EP 0565910 B1 * 12/1997 ..... A63B 69/20
EP 2437860 A1 * 4/2012 ..... A63B 69/0053

(Continued)

*Primary Examiner* — Nyca T Nguyen
(74) *Attorney, Agent, or Firm* — Edwin D. Schindler

(57) ABSTRACT

A punch bag support assembly includes a mounting unit, a first elongate arm pivotally connected at a first end to the mounting unit and a second elongate arm pivotally connected at a first end to the second end of the first elongate arm. A mounting device for a punch bag is arranged adjacent the second end of the second elongate arm. The connection between the mounting unit and the first elongate arm or the connection between the first elongate arm and the second elongate arm, or both connections, is provided with a spring mechanism.

19 Claims, 5 Drawing Sheets

(56) References Cited

U.S. PATENT DOCUMENTS

| | | | | |
|---|---|---|---|---|
| 2005/0003936 | A1* | 1/2005 | Schwendemann | A63B 69/22 482/83 |
| 2010/0130333 | A1* | 5/2010 | Strong | A63B 71/023 482/83 |
| 2015/0011366 | A1* | 1/2015 | Hockridge | A63B 69/305 29/428 |
| 2018/0161657 | A1* | 6/2018 | Direnzo | A63B 69/0002 |
| 2019/0118059 | A1 | 4/2019 | Partlo | |

FOREIGN PATENT DOCUMENTS

| | | | | | |
|---|---|---|---|---|---|
| GB | 2434112 | A | * | 7/2007 | A63B 24/0003 |
| GB | 2501730 | A | | 11/2013 | |
| WO | WO-2010124694 | A1 | * | 11/2010 | A63B 69/0053 |

* cited by examiner

PUNCH BAG SUPPORT ASSEMBLY

FIELD OF THE INVENTION

The invention relates to punch bag support assemblies. As used herein, the term punch bag covers other training devices which are intended to be struck by the user, an example being a torso pad.

BACKGROUND TO THE INVENTION

Traditionally, punch bags used for the training of athletes, including boxers, have comprised a stationary bag suspended by a strap and mounted on a spring or between two straps with inherent elasticity. The punch bag returns to a position in front of the boxer after he has hit it. Such a comparatively stationary punch bag does not provide a realistic workout. In practice, a real opponent would move about much more in relation to the subject boxer. U.S. Pat. No. 5,048,822 discloses a punch bag support assembly including a track from which the punch bag may be suspended, a drive for moving the punch bag along the track, and control apparatus for controlling the speed and direction of movement along the track. GB2434112 discloses a punch bag support assembly which includes a linear mechanism which supports the punch bag and allows its linear movement along a given length of track. First and second rotary mechanisms enable rotation about first and second axes respectively.

EP2437860 discloses a punch bag support assembly having a base, a first movable disc rotatably connected to the base and a second movable disc rotatably connected to the first movable disc. This arrangement is claimed to give rise to an unpredictable movement pattern for a punch bag mounted on the support assembly.

STATEMENTS OF THE INVENTION

According to the present invention, there is provided a punch bag support assembly comprising:

- a mounting unit;
- a first elongate arm pivotally connected at a first end to the mounting unit;
- a second elongate arm pivotally connected at a first end to the second end of the first elongate arm; and
- mounting means for a punch bag arranged adjacent the second end of the second elongate arm,
- wherein the connection between the mounting unit and the first elongate arm and/or the connection between the first elongate arm and the second elongate arm is provided with means for urging the or each arm towards predetermined positions relative to the mounting unit and/or the other arm.

Preferably, the or each urging means is a spring.

Preferably, the assembly is provided with at least one damper. The or each damper may be, for instance, an adjustable spring.

Preferably, a damper is provided at the pivotal connection between the mounting unit and the first elongate arm and/or at the pivotal connection between the first elongate arm and the second elongate arm.

Preferably, at least one connection comprises a bearing assembly.

Preferably, the mounting means comprises a spring.

Preferably, the mounting unit comprises a plate provided with means whereby the assembly may be attached to a suitable support structure.

Preferably, the assembly comprises means for locking the two arms together.

Alternatively or additionally, the mounting unit preferably comprises mean whereby a punch bag may be suspended directly from the mounting unit.

Preferably, the or each arm is a hollow, rectangular cross-section element.

Preferably, the arms are slightly curved.

Preferably, bearings are provided between the mounting unit and the first arm and between the first arm and the second arm.

Preferably, the bearings are located within bearing housings within each of which is mounted a spring arrangement provided with means for causing the movement of the punch bag to become jerky.

The present invention also provides a method of providing punch bag training comprising providing a punch bag support assembly according to any of the preceding claims, attaching a punch bag to said punch bag support assembly whereby striking the punch bag will cause it to follow a complex path of movement due to the connections between the mounting unit and the first elongate arm and between the first elongate arm and the second elongate arm.

DETAILED DESCRIPTION OF THE INVENTION

Embodiments of the present invention will now be described, by way of examples only, with reference to the accompanying drawings.

Figure 1:
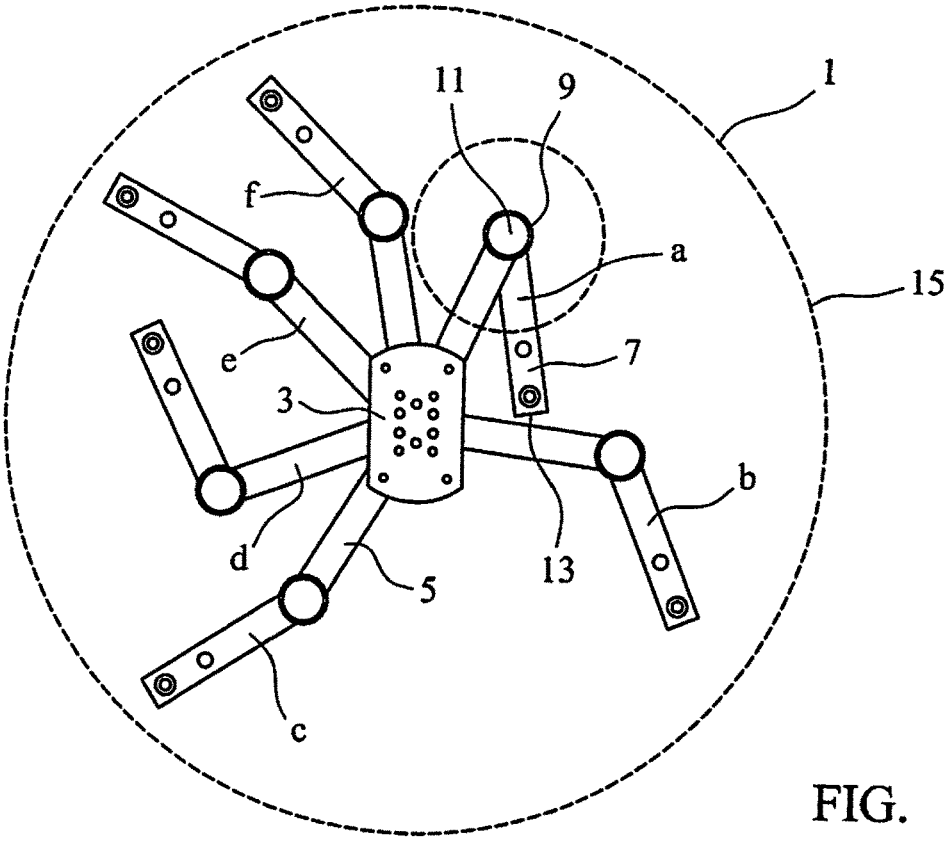
FIG. 1 is a diagrammatic top plan view of a first embodiment of a punch bag support assembly of the invention.

Referring to FIG. 1 of the accompanying drawings, punch bag support apparatus 1 in accordance with the present invention comprises a mounting unit 3 which, in use, is fixed to a ceiling or other suitable support structure. A first elongate arm 5 is pivotally connected at a first end (hidden by the mounting unit 3) to the mounting unit 3. A second elongate arm 7 is pivotally connected at a first end 9 to the second end 11 of the first elongate arm. Mounting means (not shown) for a punch bag are arranged adjacent the second end 13 of the second elongate arm 7. Spring mechanisms are provided at one or both of the connections between the first arm 5 and the mounting unit 3 and between the second arm 7 and the first arm 5. The spring mechanisms act to resist the pivotal movement of the arms, tending to return them to stationary positions.

FIG. 1 illustrates various possible positions, a-f, of the arms 5 and 7 during use of a punch bag supported by the apparatus 1. A 360° span of movement within the dotted circle 15 is enabled and the path of the punch bag is difficult or impossible for the user to predict, thereby providing a realistic simulation of the movements of a real opponent.

The punch bag may be suspended from the apparatus 1 by a fixed connection or by one that provides twist and snagging reduction by the use of a swivel hook holder. Accordingly, the assembly may be operated in an entirely stationery mode, in a swivel mode and in a manner allowing relative pivotal movement between the arms, that is to say, encompassing at least three functions provided by a single assembly.

Figure 2:
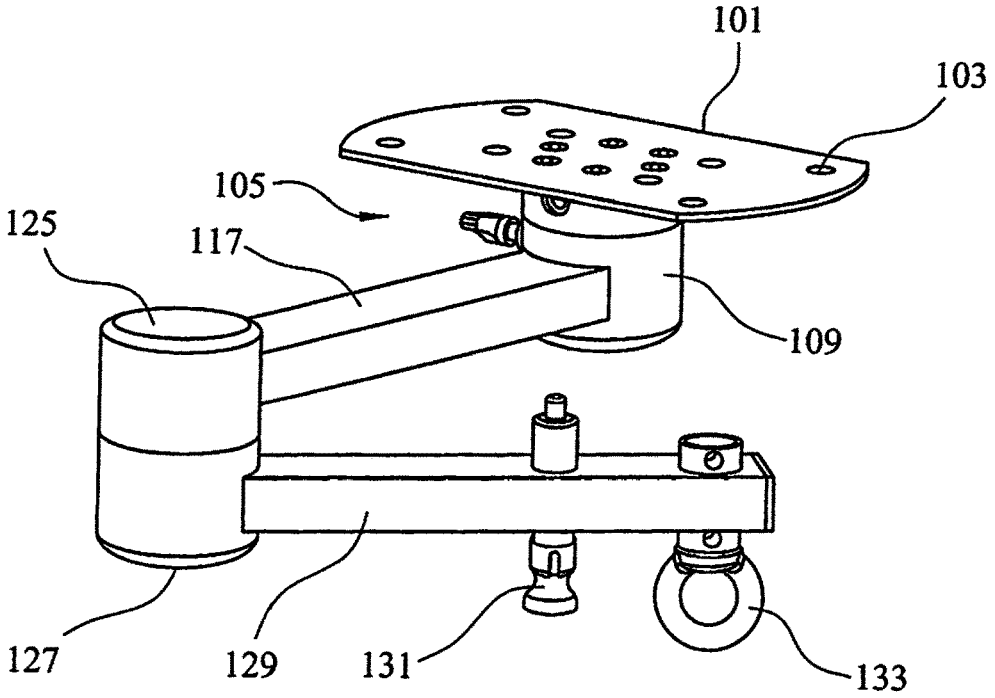
FIG. 2 is a perspective view of a second embodiment of a punch bag support assembly in accordance with the present invention.
Figure 2A:
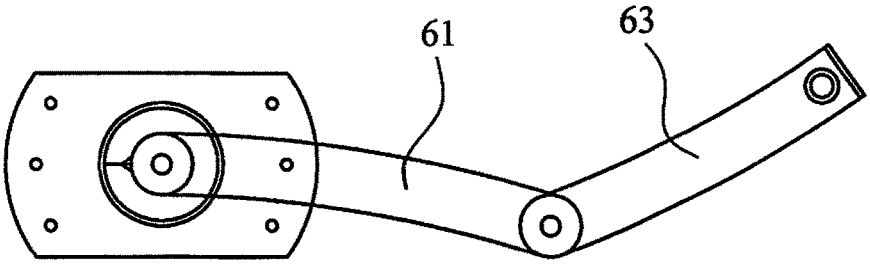
FIG. 2A is a partial view of a third embodiment of a punch bag support assembly in accordance with the present invention.
Figure 3A:
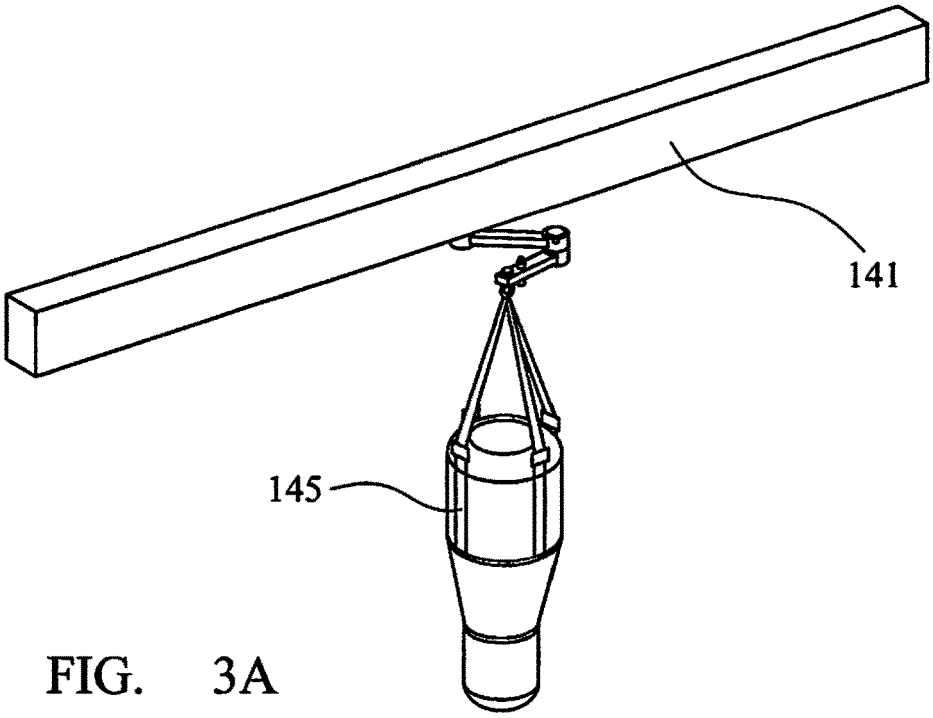
FIGS. 3A and 3B show the support assembly of FIG. 2 having a punch bag attached thereto.
Figure 3B:
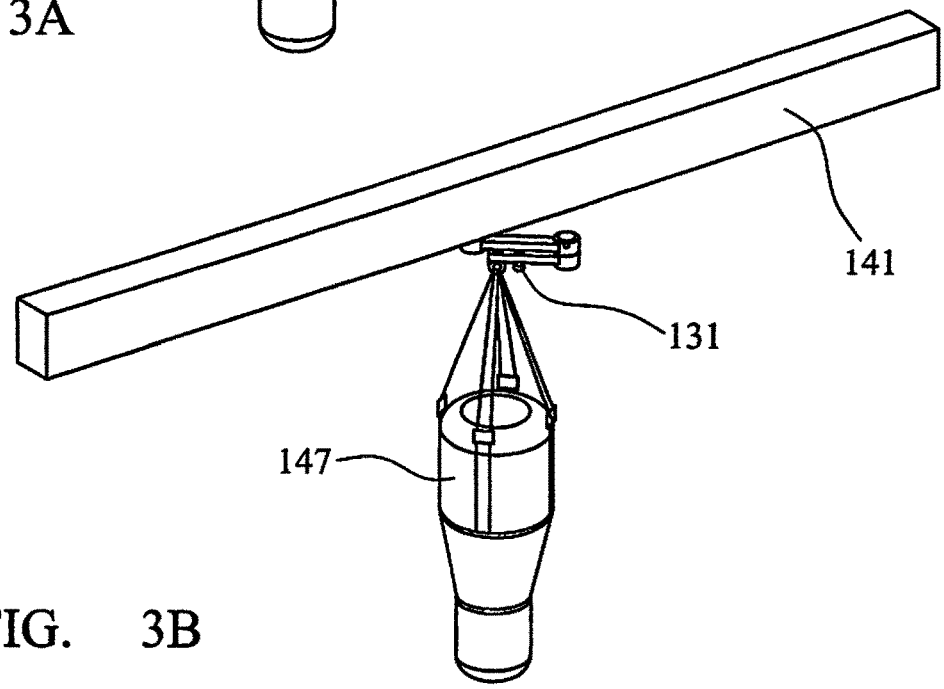

FIGS. 3A and 3B of the accompanying drawings illustrate the assembly secured to a beam 141 and arranged to operate in a manner allowing relative moment between the arms (FIG. 2A) and in the swivel mode in which the arms 5 and 7 are locked together by a locking screw 131 (FIG. 2B).

Figure 3C:
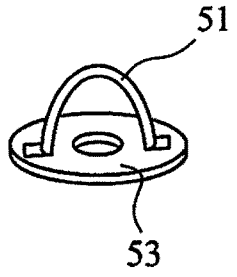
FIG. 3C shows a device for attaching a punch bag to the bearing housing of the support assembly of FIG. 2.

Referring to FIG. 3C, there is illustrated an alternative way of operating a punch bag in a stationery mode. This involves locating a punch bag on the loop 51 of a tie down ring 53 which is located on the lower end of the bearing housing 109 of the assembly. Ring 53, from which the punch bag hangs, can be pivoted to one side, when the punch bag is not attached, to allow access to the housing screw which holds the bearing housing 109 together.

In an alternative embodiment shown in FIG. 2A, the arms 61 and 63 are slightly curved, the effect of which is to reduce or eliminate the jarring issues during use of the assembly.

Figure 4:
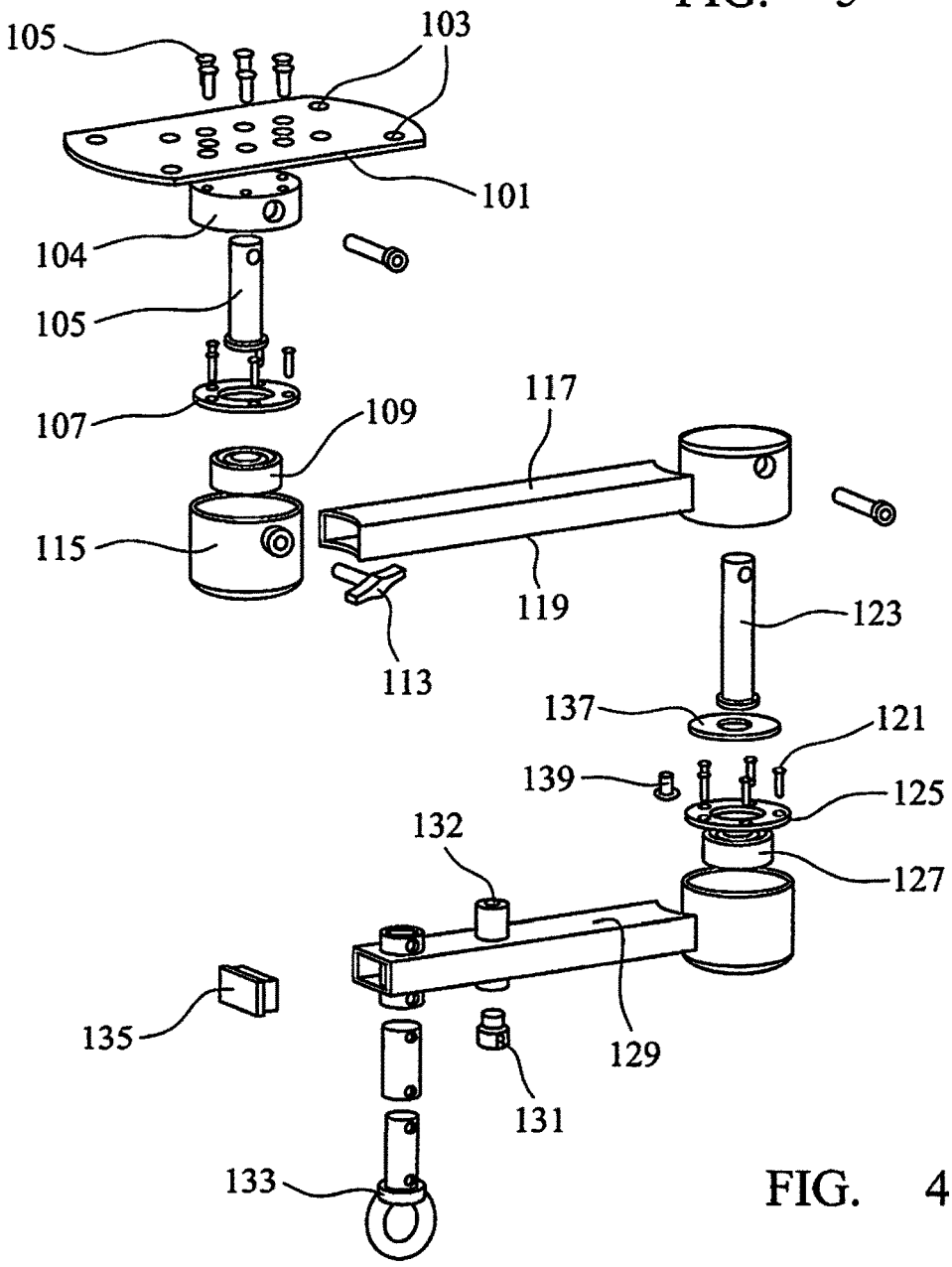
FIG. 4 shows the components of the support assembly of FIG. 2.

Referring in more detail to FIGS. 2 and 4 of the accompanying drawings, the depicted embodiment of a punch bag support assembly 105 in accordance with the present invention includes a fixing plate 101 having fixing holes 103 by means of which the plate 101 may be attached to a support structure such as a ceiling. Extending downwardly from the centre of plate 101 is a disc 104 which is attached to plate 101 by rod or bolt 105 which in turn extends via disc 107 into a bearing housing 109 provided with a cap end 115.

An adjustable nylon damper screw 113 extends into bearing housing 109, the end of which is received by a damper screw receiver located within housing 109. Damper screw 113 is capable of being screwed into a chosen degree of engagement with bolt 105 to effect a desired degree of damping of the rotation of bearing housing 109 about bolt 105.

Extending horizontally from bearing housing 109 is a hollow primary arm 117 which is rectangular in cross section and which is provided at its end remote from housing 109 with a bearing housing 121 which includes upper and lower bearing components 125 and 127 and a bolt 123 extending axially through these components. Connected to bearing housing 121, at a position below that of primary arm 117, is a secondary arm 129 which extends horizontally in a plane below that of primary arm 117.

Figure 5:
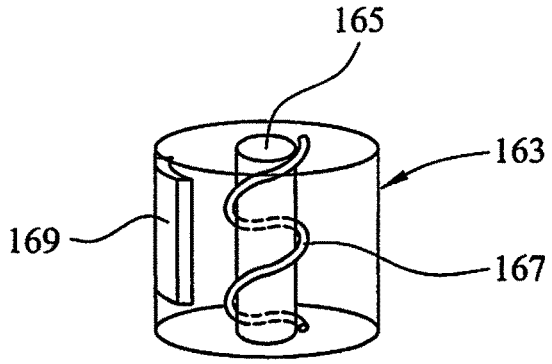
FIG. 5 shows detail of a spring arrangement forming part of a support assembly such as that of FIG. 2.

Provided within bearing housing 121 is a spring arrangement such as that illustrated as 163 in FIG. 5. Spring 167 is mounted on carrier rod 165. A catch 169 is located in such a position that detents extending radially outwardly from rod 165 engage with catch 169 causing the movement of the punch bag to become jerky, thereby more closely resembling the movement of an opponent in a real fight situation.

Secondary arm 129 has, extending vertically therethrough at a mid-position therealong, a locking screw hole 132 within which a locking screw 131 is located. Locking screw 131 may be turned so that its shank extends through screw hole 132 into engagement with a locking screw receptor 119 located on the underside of primary arm 119 in order to prevent relative rotational movement between the primary and secondary arms 117 and 129.

The end of secondary arm 129 is provided with a cap end 135.

Extending downwardly from that end of secondary arm 129 remote from bearing housing 121 is a directional spring (not shown) to which is attached a bolt hook 133 whereby a punch bag or the like may be attached to the support assembly.

The damper screws may be made of any suitable material including metal and plastics. Rod or bolt 105 may be welded to fixing plate 101 and grub screws used to secure the assembly in place.

Figure 6:
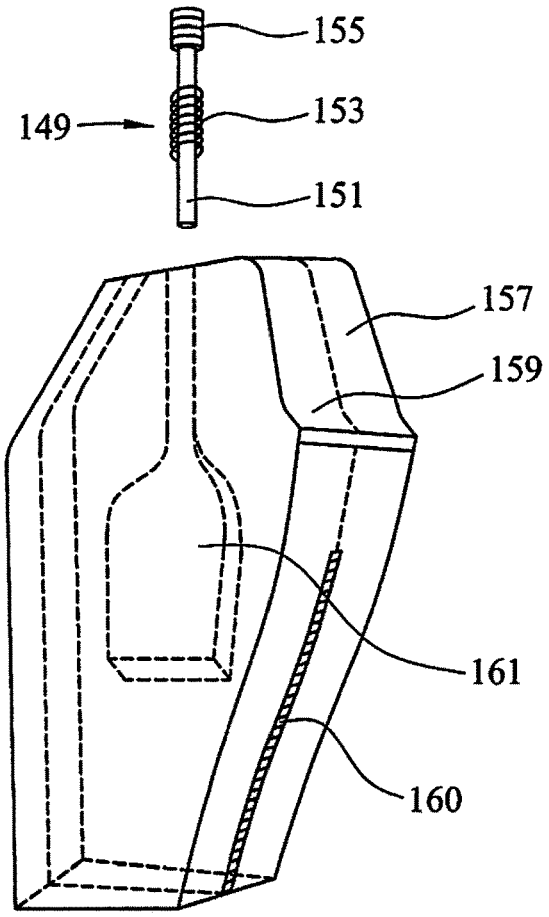
FIG. 6 shows a punch pad for use with the support assembly of FIG. 2.

FIG. 6 of the accompanying drawings shows a torso pad 157 which is formed from pieces of impact foam 159 located within a cover having a zip 160. Located within the pad is a stabiliser paddle 161 which is connected to the support assembly by means of connector 149 having a tube 151, spring 153 and locking attachment 155.

The spring 153 in the middle of tube 151 results in the motion of the torso pad being highly random. This, together the effect of the spring arrangement 163 (FIG. 5), creates a truly realistic behaviour of the pad in use compared with the movements of an opponent during a competitive fight. This is the case during relatively slow movement of the pad due at least in part to the snap/release action provided by the stored energy of the spring.

Figure 7:
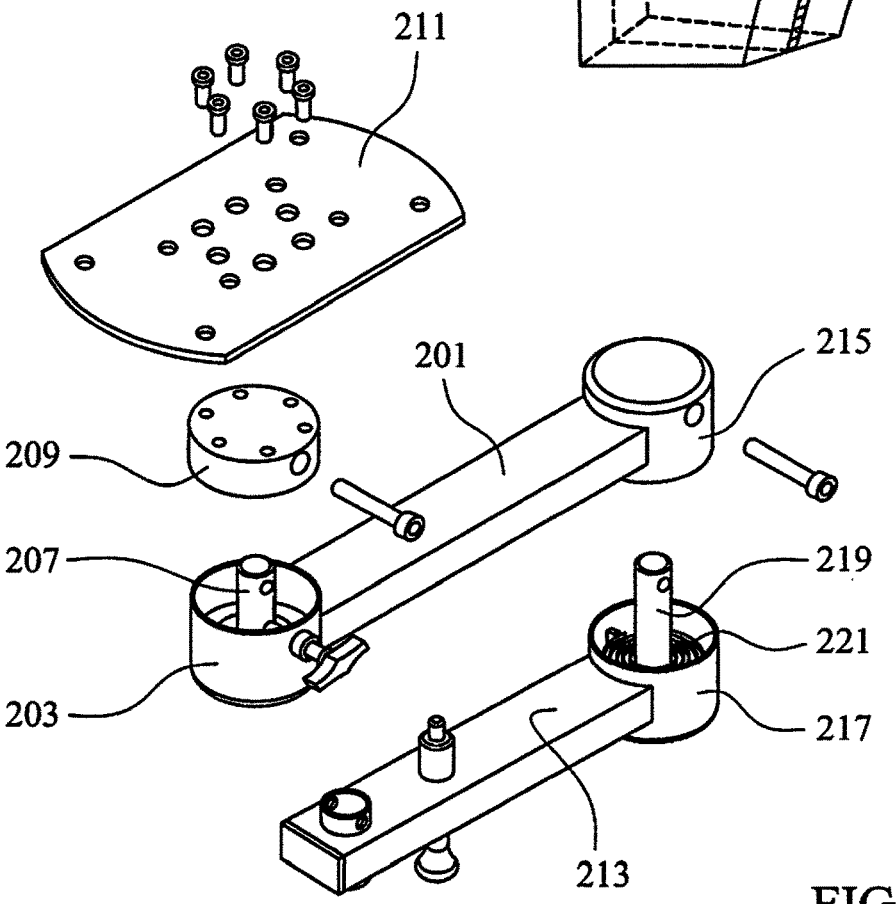
FIG. 7 is an exploded, perspective view of a fourth embodiment of a punch bag support assembly in accordance with the present invention.
Figure 8:
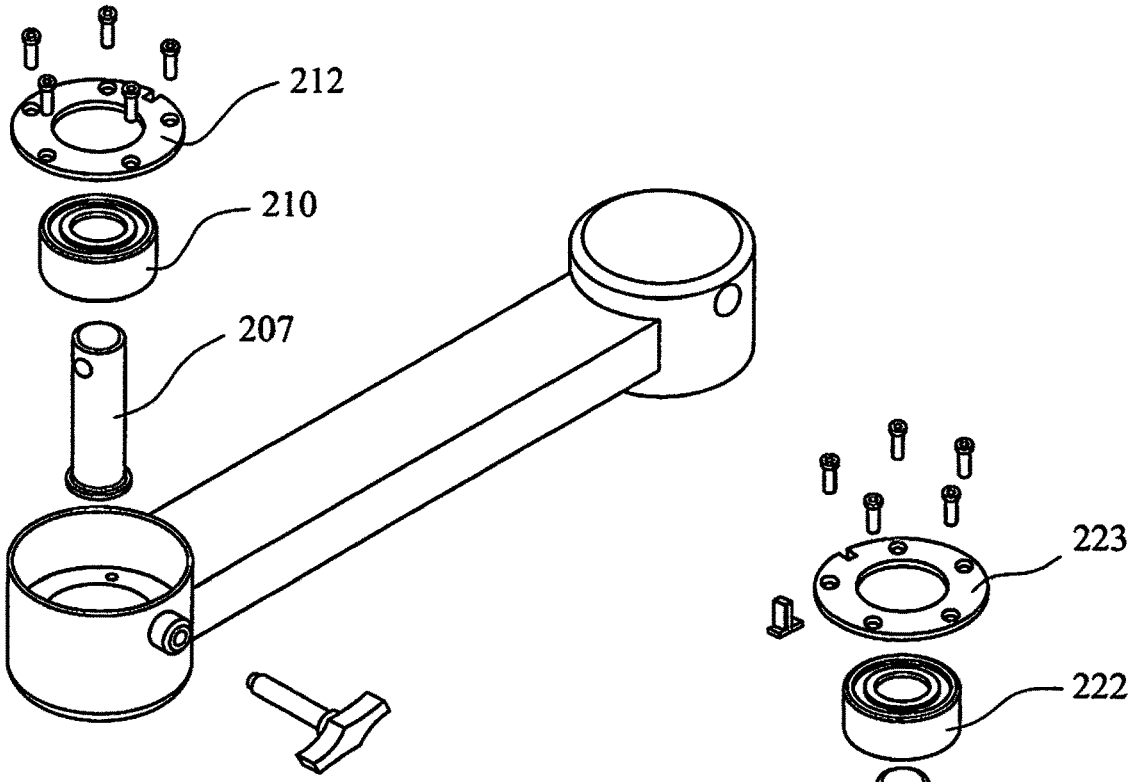
FIG. 8 is an exploded perspective view of the primary arm of the embodiment of FIG. 7.
Figure 9:
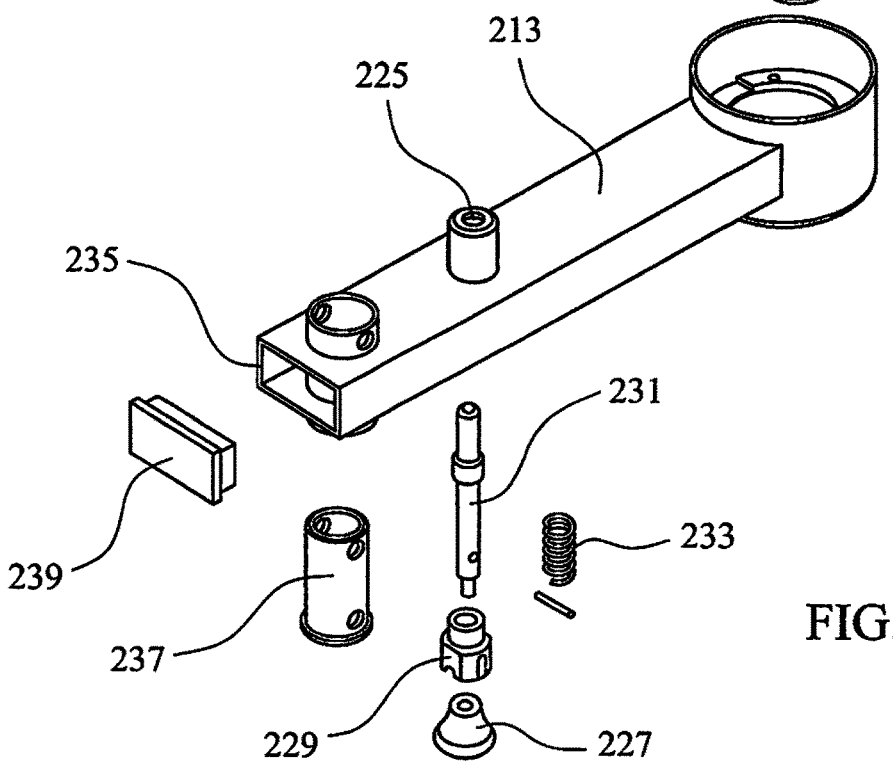
FIG. 9 is an exploded perspective view of the secondary arm of the embodiment of FIG. 7.

Referring to FIGS. 7 to 9 of the accompanying drawings, a fourth embodiment of a punch bag support assembly in accordance with the present invention is broadly similar to the above-described third embodiment. Primary arm 201 has at one end a housing 203 which is pivotally attached to bearing plate 211 via a shaft 207, a further housing 209, a bearing 210 and a bearing retaining plate 212.

The other end of primary arm 201 is pivotally attached to a secondary arm 213 by housing components 215 and 217 which together house a shaft 219 a spring 221, a bearing 210 and a bearing retaining plate 223. Spring 221 is a flat stainless steel coil spring having radially directed ends which engage in respective slots in shaft 219 and housing 217. Extending through arm 213 about two thirds of the way along the arm from its pivotally attached end is locking bolt arrangement 225 which allows the two arms 201 and 203 to be locked together, if desired. Arrangement 225 includes a knob 227, a locking bolt 229, a locking bolt 231 and a spring 233.

At the free end 235 of secondary arm 213 there is located an attachment port bushing 237, allowing attachment of a punch bag or the like, and an end cap 239.

It will be appreciated that the invention can be embodied in different ways. For instance, the secondary arm may be provided with two further holes for the spring loaded pad to be moved closer to the centre of the jointed connection to the primary arm. This will close down the distance to the target pad and also close down the overall rotational difference of the pad. In effect, this brings the sparring distance closer to the centre of the fighting distance in relation to the pad. Overall, this simulates a fighter fighting on the counter at long distance as well as a fighter getting in close.

An extra damping thumb screw can be added to the secondary arm so as to complement the secondary arm distance change with the two extra hole fixing points for a fighter that likes to fight close in. This will result in different speeds of both arms at different adjustments from length to speed as each arm would be unique in rotation from primary to secondary.

In these ways the behaviour of the product is much more unpredictable. The product can be custom made to a different class of sparring while retaining its unique randomised action.

The invention claimed is:

1. A punch bag support assembly, comprising:

a mounting unit;

a first elongate arm pivotally connected at a first end to the mounting unit;

a second elongate arm pivotally connected at a first end to a second end of the first elongate arm;

mounting means for a punch bag arranged adjacent a second end of the second elongate arm, wherein at least one connection of a first connection between the mounting unit and the first elongate arm and a second connection between the first elongate arm and the second elongate arm is provided with means for urging at least one of the first elongate arm and the second elongate arm towards predetermined positions relative to the mounting unit or at least one of the first elongate arm and the second elongate arm; and, a damper at, at least one of, the first connection between the mounting unit and the first elongate arm and at the second connection between the first elongate arm and the second elongate arm.

2. The punch bag support assembly according to claim 1, wherein the damper located at the first connection, at the second connection, or both the first connection and the second connection comprises an adjustable pin.

3. The punch bag support assembly according to claim 1, wherein at least one of the first connection and the second connection comprises a bearing assembly.

4. The punch bag support assembly according to claim 1, wherein said means for urging at least one of the first elongate arm and the second elongate arm is a spring.

5. The punch bag support assembly according to claim 1, wherein the mounting unit comprises a plate provided with means for attaching the punch bag support assembly to a support structure.

6. The punch bag support assembly according to claim 1, wherein the mounting unit comprises means for suspending the punch bag from the mounting unit.

7. The punch bag support assembly according to claim 1, wherein at least one of the first elongate arm and the second elongate arm is a hollow, rectangular cross-section element.

8. A punch bag support assembly, comprising:

a mounting unit;

a first elongate arm pivotally connected at a first end to the mounting unit;

a second elongate arm pivotally connected at a first end to a second end of the first elongate arm;

means for locking the first elongate arm and the second elongate arm together; and, mounting means for a punch bag arranged adjacent a second end of the second elongate arm, wherein at least one connection of a first connection between the mounting unit and the first elongate arm and a second connection between the first elongate arm and the second elongate arm is provided with means for urging at least one of the first elongate arm and the second elongate arm towards predetermined positions relative to the mounting unit or at least one of the first elongate arm and the second elongate arm.

9. The punch bag support assembly according to claim 8, wherein at least one of the first connection and the second connection comprises a bearing assembly.

10. The punch bag support assembly according to claim 8, wherein said means for urging at least one of the first elongate arm and the second elongate arm is a spring.

11. The punch bag support assembly according to claim 8, wherein the mounting unit comprises a plate provided with means for attaching the punch bag support assembly to a support structure.

12. The punch bag support assembly according to claim 8, wherein the mounting unit comprises means for suspending the punch bag from the mounting unit.

13. The punch bag support assembly according to claim 8, wherein at least one of the first elongate arm and the second elongate arm is a hollow, rectangular cross-section element.

14. The punch bag support assembly according to claim 8, wherein said first elongate arm and said second elongate arm are curved.

15. A punch bag support assembly, comprising:

a mounting unit;

a first elongate arm pivotally connected at a first end to the mounting unit;

a second elongate arm pivotally connected at a first end to a second end of the first elongate arm;

bearings between the mounting unit and the first elongate arm and between the first elongate arm and the elongate second arm, the bearings being located within bearing housings and within each of the bearing housings is mounted a spring arrangement having means for causing movement of a punch bag to become jerky; and, mounting means for the punch bag arranged adjacent a second end of the second elongate arm, wherein at least one connection of a first connection between the mounting unit and the first elongate arm and a second connection between the first elongate arm and the second elongate arm is provided with means for urging at least one of the first elongate arm and the second elongate arm towards predetermined positions relative to the mounting unit or at least one of the first elongate arm and the second elongate arm.

16. The punch bag support assembly according to claim 15, wherein said means for urging at least one of the first elongate arm and the second elongate arm is a spring.

17. The punch bag support assembly according to claim 15, wherein the mounting unit comprises a plate provided with means for attaching the punch bag support assembly to a support structure.

18. The punch bag support assembly according to claim 15, wherein the mounting unit comprises means for suspending the punch bag from the mounting unit.

19. The punch bag support assembly according to claim 15, wherein at least one of the first elongate arm and the second elongate arm is a hollow, rectangular cross-section element.

* * * * *